US009609954B1

(12) United States Patent
Hamburg

(10) Patent No.: US 9,609,954 B1
(45) Date of Patent: Apr. 4, 2017

(54) SPACE SAVING CONVERTIBLE SEAT AND CHEST OF DRAWERS APPARATUS

(71) Applicant: Michael Poland Hamburg, Los Angeles, CA (US)

(72) Inventor: Michael Poland Hamburg, Los Angeles, CA (US)

( * ) Notice: Subject to any disclaimer, the term of this patent is extended or adjusted under 35 U.S.C. 154(b) by 107 days.

(21) Appl. No.: 14/705,727

(22) Filed: May 6, 2015

(51) Int. Cl.

| | |
|---|---|
| ***A47C 13/00*** | (2006.01) |
| ***A47C 3/04*** | (2006.01) |
| ***A47C 7/00*** | (2006.01) |
| ***A47C 7/62*** | (2006.01) |
| ***A47B 47/00*** | (2006.01) |

(52) U.S. Cl.
CPC ..... *A47C 13/00* (2013.01); *A47B 47/0091* (2013.01); *A47C 3/04* (2013.01); *A47C 7/002* (2013.01); *A47C 7/62* (2013.01)

(58) Field of Classification Search
USPC ... 297/1, 2, 3, 118, 119, 440.1, 440.14, 135; 312/235.4
See application file for complete search history.

(56) References Cited

U.S. PATENT DOCUMENTS 910,818 A * 1/1909 Hook ..... A47C 12/02 15/265
1,566,664 A * 12/1925 Freakes ..... A47B 83/00 297/188.11
1,950,591 A * 3/1934 Bing ..... A47C 12/02 182/33.2
1,982,111 A * 11/1934 King ..... A47C 12/02 182/29
2,291,996 A * 8/1942 Tucker ..... A47C 12/02 182/33.2
2,620,018 A * 12/1952 Pagano ..... A47B 85/04 297/123
2,672,921 A * 3/1954 Herrick ..... A47B 21/02 108/33
3,334,942 A * 8/1967 Breslow ..... A47B 47/047 108/91
3,371,963 A * 3/1968 Weller ..... A47C 5/005 297/451.8
3,570,418 A * 3/1971 Gooding ..... A47C 4/022 108/12
3,592,506 A * 7/1971 Breslow ..... A47D 1/04 297/1
3,982,784 A * 9/1976 Esser ..... A47B 83/02 108/12

(Continued)

*Primary Examiner* — David R Dunn
*Assistant Examiner* — Alexander Harrison
(74) *Attorney, Agent, or Firm* — Williams Intellectual Property; Benjamin F. Williams

(57) ABSTRACT

A space saving convertible seat and chest of drawers apparatus having a first chair superimposable inverted onto a second chair wherein a seat of the first chair nestles into a seat of the second chair when said first chair is inverted, a back of the first chair fits flush overlying a front apron of the second chair, and a front apron of the first chair nestles flush into a back of the second chair, each back of the first and second chairs thereby formative of respective sides of a chest of drawers, each of said first and second chairs having a slidable drawer disposed in position underneath each seat thereof, whereby the first and second chairs are arrangeable as a set of two chairs or as a single chest of drawers.

6 Claims, 2 Drawing Sheets

(56) References Cited

U.S. PATENT DOCUMENTS

| | | | | | |
|---|---|---|---|---|---|
| 4,050,736 | A * | 9/1977 | Karp | A47B 83/02 | 297/135 |
| 4,565,403 | A * | 1/1986 | Brown | A47B 83/02 | 108/38 |
| 4,624,502 | A * | 11/1986 | Boole | A47C 7/62 | 297/188.11 |
| 4,925,245 | A * | 5/1990 | Pendleton | A47C 17/14 | 297/111 |
| D369,684 | S * | 5/1996 | Engel | D6/335 | |
| 6,017,093 | A * | 1/2000 | Moser | B27M 1/08 | 297/232 |
| 6,068,331 | A * | 5/2000 | Barnes | A47B 83/04 | 108/180 |
| 6,089,661 | A * | 7/2000 | Åstrom | A47D 11/02 | 182/33.2 |
| 6,883,878 | B2 * | 4/2005 | Gorelick | A47B 83/00 | 297/17 |
| 6,976,732 | B2 * | 12/2005 | Thomas | A47B 85/04 | 297/1 |
| 7,311,642 | B2 * | 12/2007 | Li | A63B 23/0458 | 297/135 |
| 2006/0249994 | A1 * | 11/2006 | Drake | A47D 11/02 | 297/118 |
| 2008/0236452 | A1 * | 10/2008 | Pratt | A47B 85/00 | 108/13 |

* cited by examiner

SPACE SAVING CONVERTIBLE SEAT AND CHEST OF DRAWERS APPARATUS

BACKGROUND OF THE INVENTION

Various types of space saving furnishings are known in the prior art, particularly in urban environments where living space commands a premium and population pressures necessitate smaller living environments. What is needed, then, is a space saving convertible seat and chest of drawers apparatus that includes a first chair and a second chair positional as separate chairs and alternately arrangeable with the first chair inverted and positional atop the second chair to form a chest of drawers, wherein the angle of each of a seat of each said first and second chairs and the disposition of each of a front apron and a faceted surface of a back of each of said chairs nest flush against each other, and action of gravity maintains stacked arrangement of said first and second chairs in the form of a chest of drawers, whereby a drawer, slidably disposed under the seat of each said first and second chair is positional between an open position and a closed position for storage of items therein and economy of interior space within a home or office is readily enabled for use as each of a first and second chair and alternately as a chest of drawers, as desired.

FIELD OF THE INVENTION

The present invention relates to a space saving convertible seat and chest of drawers apparatus, and more particularly, to a space saving convertible seat and chest of drawers apparatus that includes a first chair and a second chair, each said first and second chair having a seat angled upwards from a rear edge towards a front edge, a faceted surface disposed upon a back between a ground surface, upon which each said chiar is positioned for use as a chair, and an utmost extremity, and a front apron, wherein a first portion and a second portion of the front apron is nestable flush against angled portions of the back faceted surface when the first chair is disposed inverted and positioned with the seat disposed atop the seat of the second chair, and the back of said first chair nests flush against the front apron of the second chair, whereby a chest of drawers is formable by arrangement of said first and second chairs for economic use of interior space, as desired.

SUMMARY OF THE INVENTION

The general purpose of the space saving convertible seat and chest of drawers apparatus, described subsequently in greater detail, is to provide a space saving convertible seat and chest of drawers apparatus which has many novel features that result in a space saving convertible seat and chest of drawers apparatus which is not anticipated, rendered obvious, suggested, or even implied by prior art, either alone or in combination thereof.

The present space saving convertible seat and chest of drawers apparatus has been devised to enable stacked arrangement of each of a first chair and a second chair in the form of a chest of drawers whereby each of said first and second chairs is usable individually as a seat for a user or, alternately, as a chest of drawers.

The present space saving convertible seat and chest of drawers apparatus, therefore, includes a first chair and a second chair. Each of the first chair and second chair includes a seat angled between a rear edge and a front edge. A back is disposed congruent with the rear edge, said back including a faceted surface continuously disposed between an utmost extremity atop the back and a ground surface upon which each of said first and second chair is positioned for use in sitting.

A front apron is disposed congruent with the seat front edge and includes a concave surface disposed between the seat front edge and a ground surface upon which the first and second chair is positioned for use in sitting. The front apron concave surface of the first chair is disposed to seat flush against angled portions of the faceted surface of the back of the second chair, when said first chair is inverted and positioned atop the second chair so that the seats of said first and second chairs are caused to contact each other, as will be described subsequently. Action of gravity thereby maintains stacked arrangement for use of said first and second chairs as a chest of drawers.

The back faceted surface of each of the first and second chairs includes a first angled portion, a second angled portion, and a third angled portion. The first angled portion is disposed up from a ground surface upon which said first and second chair is positioned for use as a chair to terminate at a first transverse axis disposed approximately midway between said ground surface and each of said chair's seat. The second angled portion is disposed from the first transverse axis to a second transverse axis disposed approximately midway between the seat and the back utmost extremity. The third angled portion is disposed between the second transverse axis and the utmost extremity.

The first transverse axis is disposed at a farthermost rearwards extremity of each of said first and second chair's back. The second transverse axis is disposed at a farthermost extremity frontwards of each of said first and second chair's back. Thus the faceted surface presents each first, second, and third angled portions in planes obliquely situated relative each other along said faceted surface.

The concave surface of the front apron includes a first portion disposed likewise obliquely angled relative a second portion at a medial transverse axis disposed approximately midway between the seat and a ground surface upon which each of said first and second chairs is disposed for use in sitting. The medial transverse axis is disposed in a position farthermost rearwards in the front apron. The medial transverse axis is thus disposed parallel the first transverse axis of the faceted surface of the back.

When the first chair is disposed inverted, and positioned atop the second chair with said first chair's seat superimposed upon the second chair's seat, the utmost extremity of the back of the first chair contacts a ground surface atop which the second chair is disposed, the third angled portion of the first chair's back nestles flush against the first portion of the second chair's front apron, the second transverse axis of the first chair's back disposed in parallel conjunction with the medial transverse axis of the second chair.

Further, the front apron of the first chair is disposed to nestle inverted flush against the back of the second chair, the medial transverse axis of the first chair's front apron nestled flush in parallel conjunction with the second transverse axis of the second chair. Thus the back of the first chair is disposed as a side of a chest of drawers formed when said first chair is inverted for stacked situation atop the second chair, and the back of the second chair thereby is disposed as the other side of said chest of drawers.

For means of storage of items, as desired, a drawer is disposed in each said first and second chair, positional underlying the seat in between the front apron and the back of each said chair. The drawer is movable along a transverse plane between a closed position, stored underlying the seat, and an open position, extended out from under the seat. The drawer is removable from position underlying the seat, and reversible and invertible for use when the first chair is inverted for stacked situation atop the second chair for arrangement as the chest of drawers.

The present space saving convertible seat and chest of drawers apparatus is therefore usable as each of a pair of seats and alternately as a chest of drawers, as desired.

Thus has been broadly outlined the more important features of the present space saving convertible seat and chest of drawers apparatus so that the detailed description thereof that follows may be better understood and in order that the present contribution to the art may be better appreciated.

Objects of the present space saving convertible seat and chest of drawers apparatus, along with various novel features that characterize the invention are particularly pointed out in the claims forming a part of this disclosure. For better understanding of the space saving convertible seat and chest of drawers apparatus, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
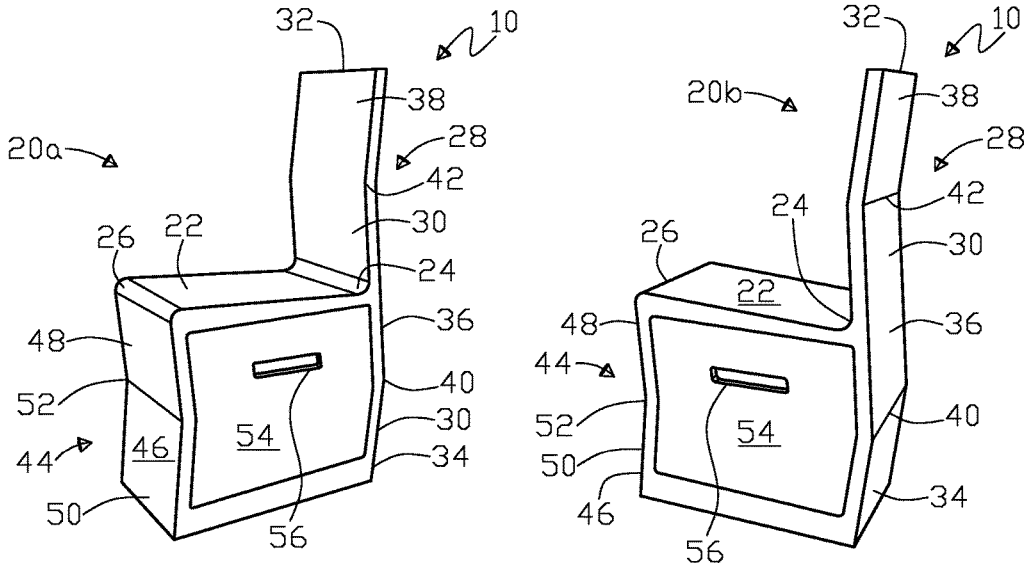
FIG. 1 is an isometric view of an example embodiment of a first chair and a second chair separately disposed as a set of two chairs.
Figure 2:
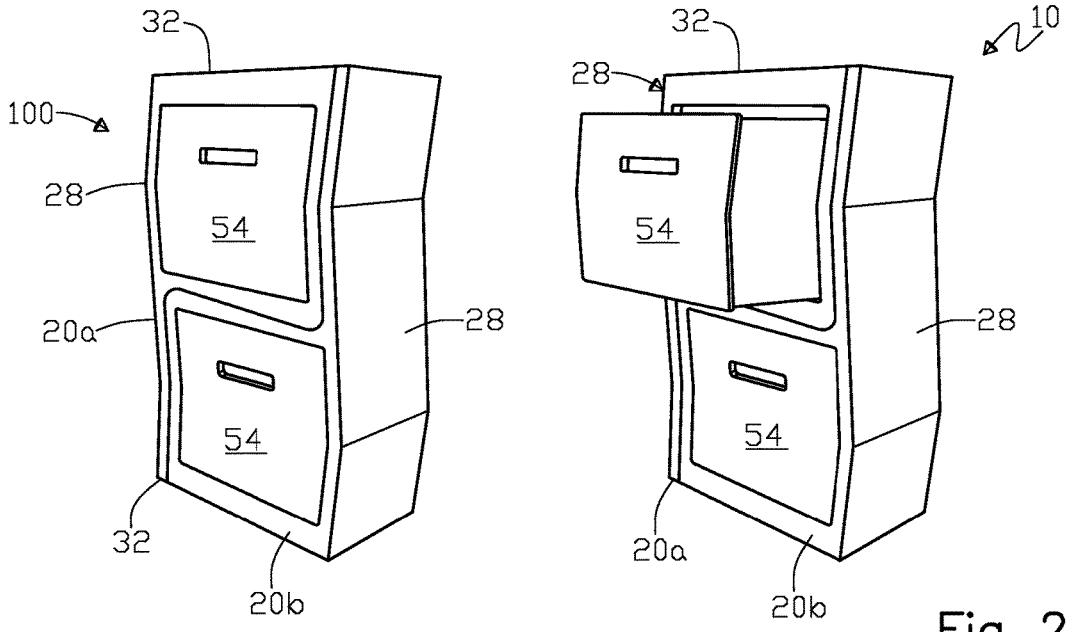
FIG. 2 is an isometric view of the first chair inverted and positioned atop the second chair to create a chest of drawers.
Figure 3:
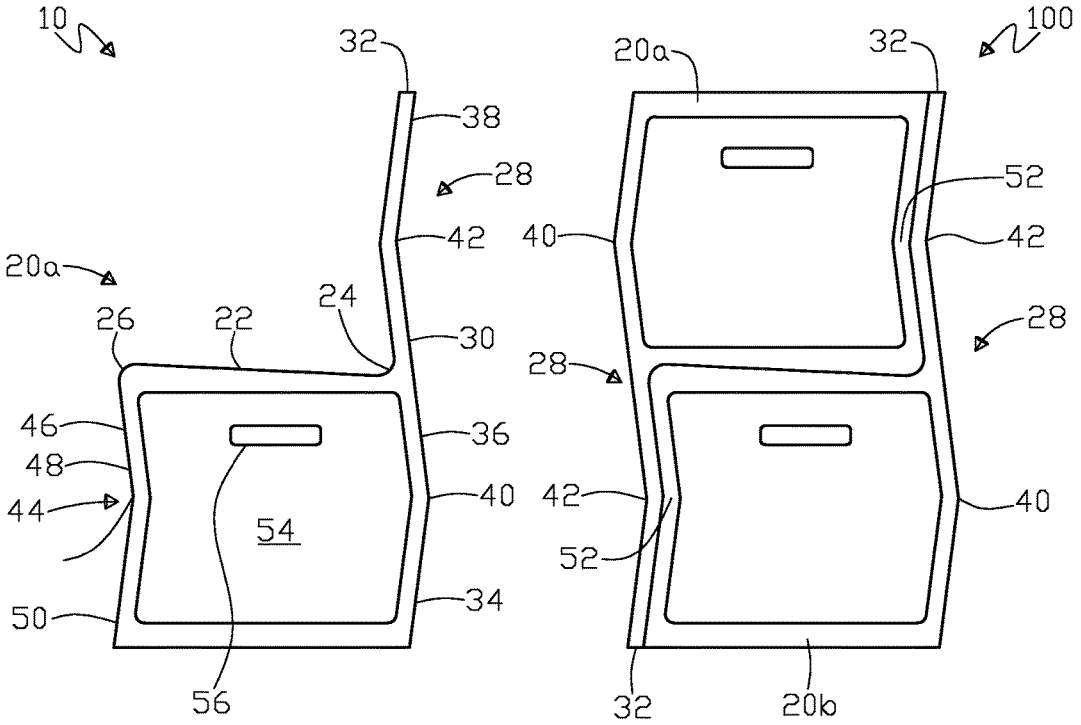
FIG. 3 is a side view of a first chair and of a first chair inverted atop a second chair in the form of the chest of drawers.

With reference now to the drawings, and in particular FIGS. 1 through 3 thereof, example of the instant space saving convertible seat and chest of drawers apparatus employing the principles and concepts of the present space saving convertible seat and chest of drawers apparatus and generally designated by the reference number 10 will be described.

Referring to FIGS. 1 through 3 a preferred embodiment of the present space saving convertible seat and chest of drawers apparatus 10 is illustrated.

The present space saving convertible seat and chest of drawers apparatus 10 has been devised to enable efficient space saving arrangement wherein a first chair 20*a* and a second chair 20*b* are positional as a set of two, separate chairs, or re-positional with the first chair 20*a* inverted and stacked superimposed upon a seat of a second chair 20*b* to form a chest of drawers 100.

Each of the first and second chair 20*a*, 20*b*, therefore, includes a seat 22 disposed angled from a rear edge 24 up towards a front edge 26 whereby position of the first chair 20*a* inverted, to position said first chair's 20*a* seat 22 atop the second chair's 20*b* seat 22, enables action of gravity to maintain inverted engagement of said first chair 20*a* atop the second chair 20*b*.

Each of the first and second chairs 20*a*, 20*b* also includes a back 28 disposed as an angled, faceted surface 30 conjunct the seat 22 rear edge 24. The back 28 comprises a continuous surface disposed from any ground surface upon which each said chair 20*a*, 20*b* is positioned, to an upmost extremity 32 of said back 28. The faceted surface 30 includes a first angled portion 34, disposed up from said ground surface; a second angled portion 36, disposed atop the first angled portion 34 and obliquely angled relative the first angled portion 34, said second angled portion 36 conjunct the first angled portion 34 at a first transverse axis 40, which first transverse axis 40 is disposed protruding farthermost backwards from the back 28; and a third angled portion 38, disposed atop the second angled portion 36 obliquely angled relative said second angled portion 36, said third angled portion 38 conjunct the second angled portion 36 at a second transverse axis 42 disposed protruded farthermost frontwards from the back 28. Thus the back 28 faceted surface 30 comprises angled portions 34, 36, 38 disposed conjunct a first transverse axis 40 protruded farthermost backwards form the back 20 and a second transverse axis 42 disposed protruding farthermost frontwards from said back 28.

In an example embodiment illustrated herewith, the first transverse axis 40 is disposed upon the faceted surface 30 approximately midway between the seat 22 and an underlying ground surface and the second transverse axis 42 is disposed approximately midway between said seat 22 and the utmost extremity 32 of the back 28.

Each of said first and second chairs 20*a*, 20*b* further includes a front apron 44 disposed as an angled, concave surface 46 disposed from the seat 22 front edge 26 to an underlying ground surface. The concave surface 46 has a first portion 48 disposed in parallel with the second angled portion 36 of the back 28. The first portion 48 is angularly disposed relative a second portion 50, disposed in parallel with the first angled portion 34 of the back 28. The first and second portions 48, 50 are disposed obliquely convergent at a medial transverse axis 52 therebetween, said medial transverse axis 52 disposed parallel the first transverse axis 40 of the back 28.

Thus, when the first chair 20*a* is inverted for position with seat 22 disposed atop the seat 22 of the second chair 20*b*, and the first and second chairs 20*a*, 20*b* thereby render the chest of drawers 100, the front apron 44 of the first chair 20*a* nests flushly into the back 28 of the second chair 20*b*, whereby the medial transverse axis 52 of the front apron 44 is positional conjunct the second transverse axis 42 of the back 28.

Each of the first and second chairs 20*a*, 20*b* includes a drawer 54 disposed under the seat 22. The drawer 54 is slidable within a transverse plane relative the chair 20*a*, 20*b* and is thereby usable for storage. The drawer 54 includes a handle member 56. The drawer 54 is invertible and reversibly positional beneath the seat 22, as desired, whereby the drawer 54 is positional upright when the chair 20*a*, 20*b* is disposed in an upright position and the drawer 54 may be turned upright when the chair 20*a*, 20*b* is inverted for use when each of the first and second chair 20*a*, 20*b* is disposed stacked as a chest of drawers 100.

Thus the first chair 20*a* is superimposable inverted onto the second chair 20*b*, the seat 22 of the first chair 20*a* fits flushly onto the seat 22 of the second chair 20*b* when said first chair 20*a* is inverted, the back 28 of the first chair 20*a* fits flush overlying the front apron 44 of the second chair 20*b*, and the front apron 44 of the first chair 20*a* nestles flush into the back 28 of the second chair 20*b*, each back 28 of the first and second chairs 20*a*, 20*b* thereby formative of respective sides of a chest of drawers 100, whereby the first and second chairs 20*a*, 20*b* are arrangeable as a set of two chairs 20*a*, 20*b* separately disposed or as a single chest of drawers 100, as desired.

What is claimed is:

1. A space saving convertible seat and chest of drawers apparatus comprising:

a first chair having:

a seat;

a back;

a front apron;

a drawer disposed under the seat, said drawer slidable within a transverse plane relative the chair;

a second chair having:

a seat;

a back;

a front apron;

a drawer disposed under the seat, said drawer slidable within a transverse plane relative the chair;

wherein the first chair is superimposable inverted onto the second chair, the seat of the first chair fits flushly onto the seat of the second chair when said first chair is inverted, the back of the first chair fits flush overlying the front apron of the second chair, and the front apron of the first chair nestles flush into the back of the second chair, each back of the first and second chairs thereby formative of respective sides of a chest of drawers, whereby the first and second chairs are arrangeable as a set of two chairs separately disposed or as a single chest of drawers.

2. The space saving convertible seat and chest of drawers apparatus of claim 1 wherein the front apron of each of said first and second chair extends to a ground surface whereon each first and second chairs is placed when each first and second chair is disposed as two chairs separately.

3. The space saving convertible seat and chest of drawers apparatus of claim 2 wherein the back of each of the first and second chairs is disposed congruent as a single surface from a ground surface to the upmost extremity of said back of said first and second chair, when each first and second chair is disposed as two chairs separately.

4. The space saving convertible seat and chest of drawers apparatus of claim 3 wherein the front apron of each of the first and second chairs includes an angled, concave surface, said concave surface having at least a first portion angularly disposed relative at least a second portion, said first and second portions disposed obliquely convergent at a medial transverse axis therebetween.

5. The space saving convertible seat and chest of drawers apparatus of claim 4 wherein the back of each of the first and second chairs includes an angled, faceted surface, said faceted surface having at least a first angled portion angularly disposed relative at least a second angled portion, said first and second angled portions disposed obliquely convergent at at least a first transverse axis therebetween, wherein the faceted surface is superimposable into the concave surface when one of the first and second chair is inverted and placed onto the other of said first and second chair.

6. A space saving convertible seat and chest of drawers apparatus comprising:

a first chair having:

a seat disposed angled from a rear edge up towards a front edge;

a back disposed as an angled, faceted surface disposed from a ground surface upon which the first chair is placed to an upmost extremity of said back, said back conjunct the rear edge of the seat, said faceted surface having:

a first angled portion disposed up from said ground surface;

a second angled portion disposed atop the first angled portion obliquely angled relative said first angled portion, said second angled portion conjunct the first angled portion at a first transverse axis, said first transverse axis disposed protruding farthermost backwards from the back;

a third angled portion disposed atop the second angled portion obliquely angled relative said second angled portion, said third angled portion conjunct the second angled portion at a second transverse axis disposed protruded farthermost frontwards from the back;

a front apron disposed as an angled, concave surface disposed from the seat front edge to a ground surface, said concave surface having:

a first portion disposed in parallel with the second angled portion of the back, said first portion angularly disposed relative a second portion disposed in parallel with the first angled portion of the back, said first and second portions disposed obliquely convergent at a medial transverse axis therebetween;

a drawer disposed under the seat, said drawer slidable within a transverse plain plane relative the chair;

a second chair having:

a seat disposed angled from a rear edge up towards a front edge;

a back disposed as an angled, faceted surface disposed from a ground surface upon which the first chair is placed to an upmost extremity of said back, said back conjunct the rear edge of the seat, said faceted surface having:

a first angled portion disposed up from said ground surface;

a second angled portion disposed atop the first angled portion obliquely angled relative said first angled portion, said second angled portion conjunct the first angled portion at a first transverse axis, said first transverse axis disposed protruding farthermost backwards from the back;

a third angled portion disposed atop the second angled portion obliquely angled relative said second angled portion, said third angled portion conjunct the second angled portion at a second transverse axis disposed protruded farthermost frontwards from the back;

a front apron disposed as an angled, concave surface disposed from the seat front edge to a ground surface, said concave surface having:

at least a first portion angularly disposed relative at least a second portion, said first and second portions disposed obliquely convergent at a medial transverse axis therebetween;

a drawer disposed under the seat, said drawer slidable within a transverse plane relative the chair;

wherein the first chair is superimposable inverted onto the second chair, the seat of the first chair fits flushly onto the seat of the second chair when said first chair is inverted, the back of the first chair fits flush overlying the front apron of the second chair, and the front apron of the first chair nestles flush into the back of the second chair, each back of the first and second chairs thereby formative of respective sides of a chest of drawers, whereby the first and second chairs are arrangeable as a set of two chairs separately disposed or as a single chest of drawers.

* * * * *